United States Patent [19]

Canamero

[11] Patent Number: 4,720,011

[45] Date of Patent: Jan. 19, 1988

[54] PACKAGE HAVING TEARSTRIP OPENER

[75] Inventor: Ernest V. Canamero, Durand, Ill.

[73] Assignee: E. I. Du Pont de Nemours and Company, Wilmington, Del.

[21] Appl. No.: 913,347

[22] Filed: Sep. 30, 1986

[51] Int. Cl.[4] ..... B65D 65/46; B65D 27/38; B65D 65/34; B65D 75/68

[52] U.S. Cl. ..... 206/455; 206/484; 206/524.3; 206/524.8; 206/610; 206/632

[58] Field of Search ..... 206/455, 456, 484, 484.2, 206/524.2, 524.3, 524.8, 610, 632; 354/275; 383/94

[56] References Cited

U.S. PATENT DOCUMENTS

| | | | |
|---|---|---|---|
| 2,643,049 | 6/1953 | Bartelt | 383/94 |
| 3,426,959 | 2/1969 | Lemelson | 206/632 |
| 3,565,328 | 2/1971 | Hudson | 206/610 |
| 3,579,397 | 5/1971 | Schwarzkapp | 206/610 |
| 3,958,693 | 5/1976 | Greene | 206/524.8 |
| 4,252,846 | 2/1981 | Romesberg et al. | 206/484 |
| 4,303,160 | 12/1981 | Weindenz et al. | 206/455 |
| 4,513,050 | 4/1985 | Akao | 206/455 |
| 4,537,307 | 8/1985 | Tamura | 206/449 |
| 4,586,611 | 5/1986 | Scalzo | 206/632 |
| 4,653,640 | 3/1987 | Akao | 206/524.2 |

FOREIGN PATENT DOCUMENTS

| | | | |
|---|---|---|---|
| 799284 | 8/1958 | United Kingdom | 206/610 |

*Primary Examiner*—Stephen Marcus
*Assistant Examiner*—Brenda J. Ehrhardt

[57] ABSTRACT

Enclosed package such as an envelope-like package, which may be substantially impermeable to gas, water and chemical vapor and preferably is essentially light opaque having two surfaces sealed together, e.g., at least one end, and having a tearstrip. The improvement comprises hot melt adhesive-covered tearstrip present between the two surfaces and is sealed in an area along the entire length of the outer edge of the tearstrip, the inner edge of the entire length of the tearstrip remaining unsealed except at the opposite ends. The seal can be opened easily by tearing in a substantially perfect line with virtually no ragged edges which impede the removal of the package contents. The package, when light opaque, is useful for containing light-sensitive photographic films, e.g., x-ray films, including x-ray intensifying screens, photopolymer elements and other light sensitive sheets. In nonlight opaque embodiments, the package can contain paper sheets, flat materials and various solid and liquid food items.

46 Claims, 6 Drawing Figures

1b
1b
2
10
11
12
13
14
15
16
17
3
4
5

PACKAGE HAVING TEARSTRIP OPENER

DESCRIPTION

1. Technical Field

This invention relates to an enclosed package. More particularly this invention relates to an enclosed package having two surfaces on at least one end sealed together with a hot melt adhesive-covered tearstrip.

2. Background of the Invention

It is known to provide tear devices, such as tear-strings or tearstrips to open envelopes or packages. For example, tear-strings sealed at only two extreme points along a side of a package have been used for opening packages: however, upon pulling the tear-string to open the package a clean straight edge cannot reproducibly be obtained due to lack of control of the tearline. Furthermore, when using a tear-string, sealed only at specific points, there is a tendency for the tear-string to break if the packaging material resists tearing, and in addition, manufacture of the package has to be precise because adhesion of the packaging material to the tear-string occurs over only a very small area resulting in the tear-string having a tendency to pull loose from the package without effectively opening it.

Hot melt adhesive impregnated tear-strings can be used as an opening device for packages. However, when these strings are heat sealed between two surfaces of packaging material, there is a tendency for the adhesive to flow outward of the string, sealing the package on either side of the string, whereby removal of the tear-string does not effectively open the package.

Tearstrips in the form of ribbons have been used on the outside of the packaging material, one on each surface thereof, along the same edge of the package. These tearstrips have the disadvantage in that a clean straight edge cannot be assured since the ribbon adhered to the outside of the packaging material does not provide a good tear guide. Tearstrips have also been used to seal two surfaces of a package together as well as open the package as shown in Smolderen et al U.S. Pat. No. 3,795,080 and 3,968,926. The tearstrip used is not stated to be a hot melt-covered tearstrip but must be a thermoplastic ribbon-like material which softens upon formation of the seal. Since the tearstrip softens upon sealing and is thermoplastically sealed, upon removing the tearstrip to open the package, substantially perfect lines with virtually no ragged edges are not obtained.

Thus, there is a need to overcome the aforementioned disadvantages of previous packages having tear-strings or tearstrips by providing a package sealed with a tearstrip which can be easily opened by removing the tearstrip which leaves a substantially perfect line with virtually no ragged edges which impede the removal of the contents of the package.

SUMMARY OF THE INVENTION

In accordance with this invention, there is provided an enclosed package having two surfaces sealed together on at least one end and having a tearstrip, the improvement wherein between the sealed surfaces is present a hot melt adhesive-covered tearstrip sealed in an area along the entire length of the outer edge of the tearstrip, the inner edge of substantially the entire length of the tearstrip remaining unsealed whereupon forcibly removing the tearstrip, the entire length of a surface of a package separates in a line along the unsealed edge of the tearstrip in the direction of the removing force, the tearstrip simultaneously delaminating from the other surface without substantially tearing said other surface thus leaving two substantially nonragged package edges that do not impede the extraction of the package contents.

In accordance with another aspect of this invention, there is provided an enclosed envelope-like package essentially light opaque and substantially impermeable to gas, water, and chemical vapor having front and rear surfaces sealed together at an end and having a tearstrip, the improvement wherein at least one sealed end, between the front and rear surfaces, comprises a hot melt adhesive-covered tearstrip sealed in an area along the entire length of the outer edge of the tearstrip, the inner edge of substantially the entire length of the tearstrip remaining unsealed, whereupon forcibly removing the tearstrip the entire length of the front surface of the package separates in a line along the unsealed edge of the tearstrip in the direction of the removing force, the tearstrip simultaneously delaminating from the rear surface without substantially tearing said rear surface thus leaving two substantially nonragged package edges that do not impede the extraction of the package contents.

In accordance with still another aspect of this invention, there is provided an enclosed envelope-like package, said package containing photographic film and made from a single folded sheet of packaging material which is essentially light opaque, substantially impermeable to gas, water and chemical vapor and having front and rear surfaces of said folded sheet sealed together at one end by means of a hot melt adhesive-covered tearstrip present between said front and rear surfaces, the seal extending in an area along the entire length of the outer edge of the tearstrip, the inner edge of substantially the entire length of the tearstrip remaining unsealed, the end of the package opposite the tearstrip sealed end being the folded end, and the ends of the package transverse to the folded and the tearstrip sealed ends thereof being sealed by the application of energy, whereupon forcibly removing the tearstrip, the entire length of the front surface of the package separates in a line along the unsealed edge of the tearstrip in the direction of the removing force, the tearstrip simultaneously delaminating from the rear surface without substantially tearing said rear surface thus leaving two substantially nonragged package edges that do not impede the extraction of said photographic film.

BRIEF DESCRIPTION OF THE DRAWINGS

The invention may be more fully understood from the following detailed description there of taken in connection with the accompanying drawings which form a part of this specification and in which.

DETAILED DESCRIPTION OF THE INVENTION

The following definitions shall apply throughout the specification and claims:

Hot melt adhesive-covered tearstrip or ribbon means a tearstrip or ribbon impregnated with hot melt adhesive or a tearstrip or ribbon coated on both sides with a hot melt adhesive.

Inner edge of tearstrip remains unsealed along substantially its entire length means the inner edge of the tearstrip is not sealed except at opposite ends transverse to the tearstrip end of the package.

The enclosed package of this invention is prepared from packaging material and at least one seal provided by a hot melt adhesive tearstrip or ribbon (hereinafter referred to throughout the specification as tearstrip or ribbon). The package can contain different type materials, examples of which are described below. To illustrate, but not limit the invention, the contents are described as photosensitive sheets or elements, e.g., photographic silver halide films with or without the presence of lead screens or x-ray intensifying screens.

The packaging material used in forming the package may be in the form of a single sheet, two sheets or a tube of packaging material. When a single sheet is used to form the package three edges require sealing. When two sheets are used, the package has four sealed edges, and when the packaging material is in tubular form, the package has only two sealed edges. The size of the sheet or sheets of material determine the size of the enclosed package. the invention not being limited to any particular size package.

Figures 1A, 1B, 1C, 1D:
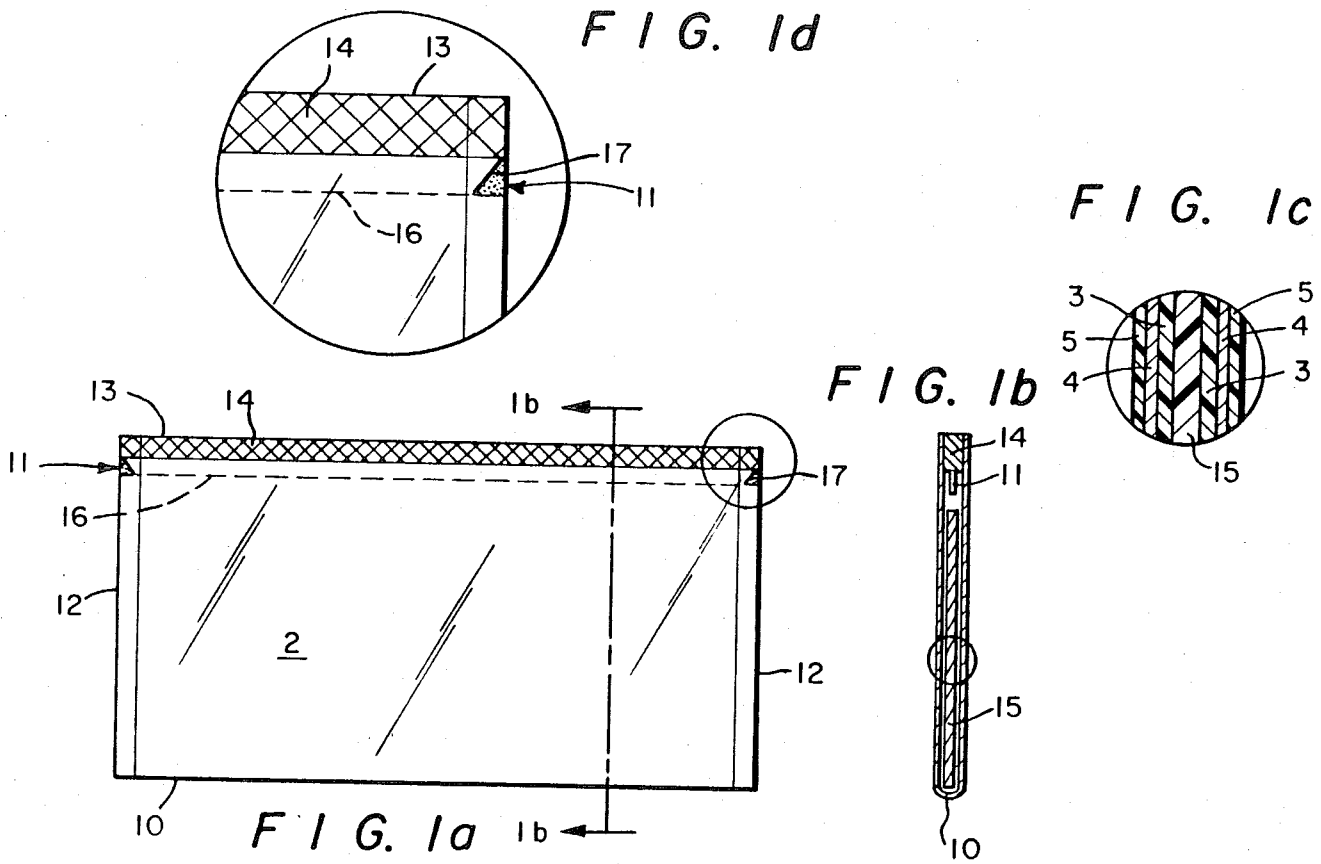
FIG. 1*a* is a view of a package having a tearstrip according to the invention.
FIG. 1*b* is a cross section along 1*b*—1*b* of FIG. 1*a*.
FIG. 1*c* is a blowup showing the cross-sectional area of a film in a configuration of the package.
FIG. 1*d* is a blowup of the upper right corner of the package showing a notch and a portion of the seal.
Figure 2:
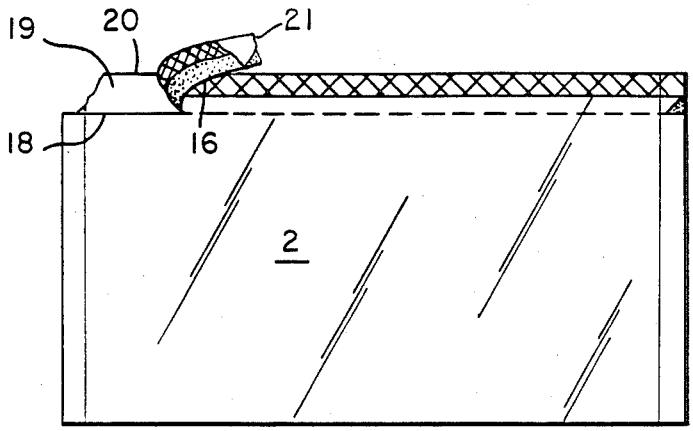
FIG. 2 is a view of a package similar to FIG. 1*a* showing the beginning of the removal of the tearstrip.
Figure 3:
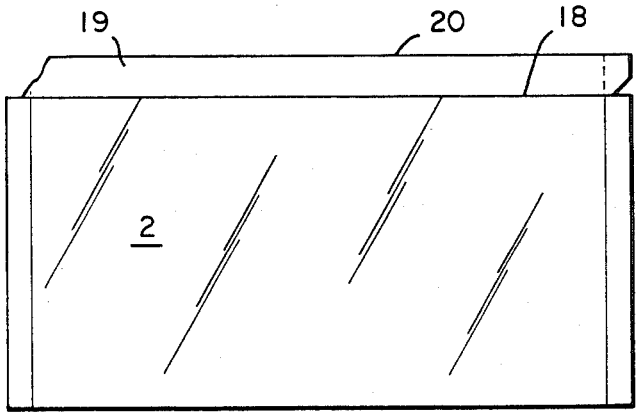
FIG. 3 is a view of a package similar to FIG. 2 showing complete removal of the tearstrip.

Referring to FIG. 1*a*, an enclosed package 2 (See FIG. 1*a*) is shown wherein two surfaces on at least one end of the package are sealed together with the tearstrip 11 present therebetween. A single sheet of packaging material is folded in half and creased along edge 10, providing adjacent edges 12 which are sealed and an edge 13 opposite the folded and creased edge. Optionally, the free ends of one or both packaging materials along edge 13 may be provided with a notch 17 which exposes a small end portion of tearstrip 11 (FIG. 1*d*) which is located between, and sealed to the inner surfaces of the packaging material located along edge 13. As noted in Example 1 below, the notch(es) can be cut completely through the package without affecting any seal. The notches provide easy access to the tearstrip when it has to be gripped 21 and pulled to open the package. Alternately, if notches are not present, a tearstrip 11 may be used having a length greater than that of the package along edge 13 or 10. Referring to FIGS. 1*b* and 1*d*, seal area 14 is shown where the two surfaces of packaging material and the tearstrip are sealed together. The inner edge of the tearstrip 16 remains unsealed over its entire length. Instead of a completely sealed area 14, as shown in FIGS. 1*b* and 1*d*, sealing together of the two surfaces of packaging material and the tearstrip may be provided with several relatively thin seal lines located across the width of the seal area and along the length of the package at edge 13. Package contents 15 may be in the form of a sheet-like material, e.g., light sensitive films, paper. etc. as shown in FIGS. 1*b* and 1*c*. Referring to FIG. 2, a substantially perfect line with virtually no ragged edges 18 is obtained when the tearstrip is removed. e.g., by forcibly pulling or removing the tearstrip. The ribbon delaminates from the packaging material on the surface 19 facing the tearstrip on the face-down side of the package resulting in two substantially perfect straight edges 18 and 20 as shown in FIG. 3 that permit the removal of the package contents without damage. This is needed especially when packaging sensitive contents which are especially susceptible to scratches, kinking or folding.

Practically any packaging material can be used to form the package provided its tear strength is less than the tensile strength of the tearstrip or ribbon. Reinforced paper, polymer coated paper, laminates of polyester, paper, and black polyolefin are found to be useful for some applications. Preferably, the packaging material used is substantially impermeable to gas, water, and chemical vapor. Suitable packaging materials impermeable to gas, water, and chemical vapor include paper coated or impregnated with a gas, water, or chemical vapor impermeable material, or laminated to such type of material. Suitable materials include metallized polyester where the metallization is in the form of a foil or a vacuum deposited layer. polypropylene, etc. When used to package light sensitive materials, the packaging material in addition to being gas, water, and chemical vapor impermeable should be opaque to light. Suitable opaque materials include laminates of black polyolefin containing carbon black, a metal layer, and a polyester film as shown in FIG. 1*c*; laminates comprising a polyolefin in between the metal and polyester layers of the above laminate, etc. Preferably the carbon black contained in the polyolefin layer makes it opaque to light. The metal layer may be in the form of a foil or it may be vacuum deposited metal. Preferably aluminum is used as the metal layer. Suitable polyolefins include preferably polyethylene, polypropylene, etc. It is preferred to vacuum package some light sensitive materials. This may be accomplished, for example, by leaving a small portion of the second transverse seal alongside 12 unsealed until the remainder of the package is sealed, applying vacuum, and then sealing the unsealed portion to retain a vacuum environment inside the package. Preferred packaging material for this application comprises a 5% carbon black containing polyethylene layer, a metal layer, and a polyester layer.

The edges of the package may be sealed by the application of energy. Suitable methods of applying energy are by heat sealing, ultrasonically welding, etc. When heat sealing is used as the method for obtaining a seal the surfaces of the packaging material facing each other are preferably thermoplastic. Sealing of the edges, with the exception of the edge containing the tearstrip, can also be accomplished using conventionally known adhesives. However, when light sensitive materials are to be packaged, the seals have to be such that they prevent "light piping" which would result in the destruction of the light-sensitive materials.

The tearstrip or ribbon is a flexible, relatively strong, stretch resistant, thermoplastic or nonthermoplastic material, e.g., high strength filaments or plastic films, having a tensile strength greater than the shear strength of the packaging material. Otherwise the tearstrip will break or cause the packaging material to fold without tearing it in a substantially perfect line with virtually no ragged edges which can impede the removal of the package contents. Preferably the tearstrip has a tensile strength of at least 40 pounds. The width of the tearstrip can vary depending on the size of the package. Generally the width is about 0.25 to 1.0 inch (~0.32 cm to 2.54 cm).

The tearstrip is covered with a hot melt adhesive. Any hot melt adhesive may be used provided it does not have a deleterious effect on the packaging material, the tearstrip, or the package contents. Furthermore, the hot melt adhesive is selected such that it provides a good seal which, as described above, when the tearstrip is forcibly removed the entire length of a surface of the package separates in a substantially perfect line while the tearstrip simultaneously delaminates from the other surface without substantially tearing the other surface. Suitable adhesives include:

(a) ethylene/vinyl esters, preferably ethylene/vinyl acetate copolymer based hot melt adhesive systems. These hot melt adhesives are nonaqueous, solvent-free and generally comprise about 10–90% by weight ethylene/vinyl acetate copolymer containing about 15–40% by weight of vinyl acetate, about 10–90% by weight of wax, preferably petroleum derived or synthetic wax, and 0–80% by weight of a thermoplastic resin such as rosin, rosin derivatives, coumarone-indene resins, terpene resins, terpene phenolic resins, permanently fusible phenolic resins and petroleum hydrocarbon resins:

(b) copolymers of ethylene with vinyl esters of lower carboxylic acids, containing minor amounts, i.e., up to about 3 weight percent of polymerizable comonomers such as acrylic acid, methacrylic acid, itaconic acid, acrylamide, beta dimethylaminoethyl methacrylate, beta hydroxy-ethyl acrylate, diallyl maleate, diallyl phthalate, diallylether or ethylene glycol dimethacrylate can be copolymerized, for exaple, with vinyl acetate, vinyl formate, vinyl propionate, vinyl butyrate, etc. Suitable melt indexes, as measured by ASTM 1238-52T, of about 2–150, preferably about 10–25, with polymerized ethylene content of about 75 weight percent. The polymerized ester content of useful ethylene copolymers is about 25 weight percent;

(c) Macromelt® resins such as polyamide types which are products of Henkel Adhesives Company, a division of Henkel Corporation, 4620 West 77th Street, Minneapolis, MN.

INDUSTRIAL APPLICABILITY

The package of this invention has many uses. In its light opaque embodiment the package is particularly useful for packaging light sensitive materials such as photographic films, e.g., x-ray, graphic arts, etc.; photopolymer elements useful for printing plates, photoresists, etc. and other light-sensitive sheet materials, e.g., diazo, cinnamates, Dylux® photoimageable materials, etc. While not forming a part of this invention suitable photographic silver halide emulsions, preparations, addenda, processing and systems are disclosed by Eastman Kodak in the December 1971 issue of Product Licensing Index in Research Disclosure No. 9232. Suitable photopolymerizable elements are disclosed in U.S. Pat. Nos. 3,469,982, 3,475,171, 3,526,504, 3,615,435, 3,649,268. 4,173,673, 4,174,216, 4,229,517, 4,323,636, and 4,323,637.

In a particularly preferred light opaque envelope-like package of this invention, 1 to 3 sheets of x-ray photographic film, either alone or sandwiched between x-ray intensifying screens or protective paper sheets, are contained therein. Preferably the packages for light-sensitive films are vacuum packages. In use, the package containing x-ray films can be exposed when attached to an object and the films are removed from the package and processed. In nonlight opaque package contents such as various solid foods, e.g., peanuts and other snack foods can be present. Such a package when substantially impermeable to gas, water, and chemical vapor is useful for containing liquids, solids in liquids, dispersions, etc. which become contaminated or affected by being exposed to air or environments having high moisture content.

EXAMPLES

The following examples wherein the percentages are by weight illustrate but do not limit the invention. The reference numbers in parentheses refer to similar numbers in the drawings.

EXAMPLE 1

A 17 inch×11 inch (43.18 cm×27.94 cm) laminate of the following layers: (a) 15 pounds black polyethylene (comprised of polyethylene, ethylene vinyl acetate, and 5% carbon black); (b) 50 pounds black Kraft paper; (c) 25 lbs. bleached polished pouch paper; and (d) 15 pounds white polyethylene, was folded in half and creased on the folded edge 10 to be 8.5 inch×11 inch (21.59 cm×27.94 cm) in overall size with the black polyethylene layer (a) of the laminate on the inside of the fold. A 0.25 inch (0.635 cm) wide. 15 inch (38.1 cm) long and 0.010 inch ±0.002 inch (0.254 cm ±0.005 cm) thick ethylene vinyl acetate based thermoplastic adhesive impregnated ribbon 11. containing 5% carbon black to prevent "light piping", and having a 40 lbs. (18 kg) ±2 lbs. (~0.91 kg) tensile strength, was held under tension along the length of the ribbon and within the free ends of the folded laminate along edge (13) such that the ends of the ribbon protruded an equal distance beyond each edge (12) of the folded laminate and the outer edge of the ribbon was flush with edge (13) of the laminate. A 0.125 inch (0.32 cm) wide polytetrafluoroethylene covered heat seal bar, heated to 290° F. (143.320 C.), was brought down at a pressure of 10 lbs./square inch (0.7 kg/cm$^2$) for 1.5 seconds over the edge (13) of the folded laminate such that the outer edge of the bar was flush with edge (13). The inner black polyethylene surfaces of the laminate along the entire edge (13), and across half the ribbon's width was sealed (14). A transverse seal was provided along one edge 12 such that the inner surfaces of the laminate at that edge were bonded together. An 8 inch×10 inch (20.32 cm ×25.4 cm) sheet of X-ray film (15) comprised of a 0.017 cm thick polyethylene terephthalate film support, two 0.000254 cm silver halide layers, one on each side of the support, and 0.000127 cm thick overcoat layer over each silver halide layer was placed into the pouch formed when edge (12) was sealed. A second transverse seal was provided in a similar manner as described above along the edge opposite that transversely sealed earlier. A triangular shaped notch (17) was punched in the edges of the package at the unsealed edge (16) of the ribbon, using a paper punch.

The package was then placed in a tropical oven at 120° F. (48.9° C.) and 70% relative humidity for 5 days. The package was then removed and laid flat on a table under safelight conditions. The free end of the ribbon at the notch was grasped at point 21 and pulled away from the package. The unsealed edge of the ribbon caused a straight edge tear 18 across the full length of the face-up side of the package. The ribbon simultaneously delaminated from the surface facing the tearstrip on the face-down side (19) of the package except at the portion initially grasped with the ribbon end. The X-ray film was easily extracted from the package without damage.

The film was then exposed and processed in a conventional manner and showed no abnormalities.

EXAMPLE 2

Example 1 as described above was repeated with the following exception: a laminate comprised of a 0.0069 cm thick polyethylene film (3) containing 5% carbon black, a 0.00035 inch (~0.00099 cm thick) aluminum foil (4) and a ~0.0011 cm thick clear polyethylene terephthalate film (5) was used instead of the laminate described in Example 1. This embodiment of the package material is shown in FIG. 1c. Similar results were obtained.

I claim:

1. An enclosed package having two surfaces sealed together on at least one end and having a tearstrip. the improvement wherein between the sealed surfaces is present a hot melt adhesive-covered tearstrip sealed in an area along the entire length of the outer edge of the tearstrip, the inner edge of substantially the entire length of the tearstrip remaining unsealed, whereupon forcibly removing the tearstrip, the entire length of a surface of the package separates in a line along the unsealed edge of the tearstrip in the direction of the removing force, the tearstrip simultaneously delaminating from the other surface without substantially tearing said other surface thus leaving two substantially nonragged package edges that do not impede the extraction of the package contents.

2. An enclosed package according to claim 1 wherein the air within the package is evacuated thus forming a vacuum package.

3. An enclosed package according to claim 1 wherein the sealed surfaces are thermoplastic polymers.

4. An enclosed package according to claim 1 wherein the sealed surfaces comprise, in order from the inner surface to the outer surface of the package, a polyolefin film, a metal layer, and a polyester film.

5. An enclosed package according to claim 4 wherein the metal layer is vacuum deposited.

6. An enclosed package according to claim 4 wherein the metal layer is a foil.

7. An enclosed package according to claim 4 wherein between the metal layer and the polyester film is a polyolefin film.

8. An enclosed package according to claim 1 wherein the packaging material is a single sheet.

9. An enclosed envelope according to claim 8 wherein the ends of the package transverse to the tearstrip-sealed end of the package are sealed by ultrasonic welding.

10. An enclosed envelope according to claim 8 wherein the ends of the package transverse to the tearstrip sealed end of the package are heat sealed.

11. An enclosed envelope according to claim 1 wherein the tearstrip is a ribbon impregnated with a hot melt adhesive.

12. An enclosed envelope according to claim 1 wherein the tearstrip is a ribbon coated on both sides with a hot melt adhesive.

13. An enclosed envelope according to claim 11 wherein the hot melt adhesive is an ethylene vinyl acetate based thermoplastic adhesive.

14. An enclosed envelope according to claim 12 wherein the hot melt is an ethylene vinyl acetate based thermoplastic adhesive.

15. An enclosed envelope according to claim 1 having a notch present in at least one edge of the package transverse to the tearstrip and at the unsealed inner edge of the tearstrip.

16. An enclosed envelope according to claim 15 wherein two notches are present, one on each edge of the package transverse to the tearstrip.

17. An enclosed envelope according to claim 1 wherein the unsealed inner edge of the tearstrip is 0.125 inch (~0.32 cm) wide.

18. An enclosed envelope-like package essentially light opaque and substantially impermeable to gas, water, and chemical vapor having front and rear surfaces sealed together at an end and having a tearstrip, the improvement wherein at least one sealed end, between the front and rear surfaces. comprises a hot melt adhesive-covered tearstrip sealed in an area along the entire length of the outer edge of the tearstrip, the inner edge of substantially the entire length of the tearstrip remaining unsealed, whereupon forcibly removing the tearstrip the entire length of the front surface of the package separates in a line along the unsealed edge of the tearstrip in the direction of the removing force, the tearstrip simultaneously delaminating from the rear surface without substantially tearing said rear surface thus leaving two substantially nonragged package edges that do not impede the extraction of the package contents.

19. An enclosed envelope-like package according to claim 18 wherein the air within the package is evacuated thus forming a vacuum package.

20. An enclosed envelope-like package according to claim 18 wherein the package sealed surfaces are thermoplastic polymers.

21. An enclosed envelope-like package according to claim 18 wherein the sealed surfaces comprise, in order from the inner surface to the outer surface of the package, a polyolefin film, a metal layer, and a polyester film.

22. An enclosed package according to claim 21 wherein the metal layer is vacuum deposited.

23. An enclosed package according to claim 21 wherein the metal layer is a foil.

24. An enclosed envelope-like package according to claim 21 wherein between the metal layer and the polyester film is a polyolefin film.

25. An enclosed envelope-like package according to claim 18 wherein the package material is a single sheet.

26. An enclosed envelope-like package according to claim 25 wherein the ends of the package transverse to the tearstrip sealed end of the package are sealed by ultrasonic welding.

27. An enclosed envelope-like package according to claim 25 wherein the ends of the package transverse to the tearstrip sealed end of the package are heat sealed.

28. An enclosed envelope-like package according to claim 18 wherein the tearstrip is a ribbon impregnated with a hot melt adhesive.

29. An enclosed envelope-like package according to claim 18 wherein the tearstrip is a ribbon coated on both sides with a hot melt adhesive.

30. An enclosed envelope-like package according to claim 28 wherein the hot melt adhesive is an ethylene vinyl acetate based thermoplastic adhesive.

31. An enclosed envelope-like package according to claim 29 wherein the hot melt adhesive is an ethylene vinyl acetate based thermoplastic adhesive.

32. An enclosed envelope-like package according to claim 18 having a notch present in at least one edge of the package transverse to the tearstrip and at the unsealed inner edge of the tearstrip.

33. An enclosed envelope-like package according to claim 32 wherein two notches are present, one on each edge of the package transverse to the tearstrip.

34. An enclosed envelope-like package according to claim 18 wherein the unsealed inner edge of the tearstrip is 0.125 inch (~0.32 cm) wide.

35. An enclosed envelope-like package according to claim 18 wherein at least one silver halide photographic film element is present within the package.

36. An enclosed envelope-like package according to claim 19 wherein at least one silver halide photographic film element is present within the package.

37. An enclosed envelope-like package according to claim 18 wherein at least one silver halide film element is coated on both sides.

38. An enclosed envelope-like package according to claim 19 wherein at least one silver halide photographic film element is coated on both sides.

39. An enclosed envelope-like package according to claim 35 wherein at least one silver halide photographic film element is sandwiched between x-ray intensifying screens.

40. An enclosed envelope-like package according to claim 35 wherein at least one silver halide photographic film element is sandwiched between paper sheets.

41. An enclosed envelope-like package, said package containing photographic film and made from a single folded sheet of packaging material which is essentially light opaque, substantially impermeable to gas, water, and chemical vapor and having front and rear surfaces of said folded sheet sealed together at one end by means of a hot melt adhesive-covered tearstrip present between said front and rear surfaces, the seal extending in an area along the entire length of the outer edge of the tearstrip, the inner edge of substantially the entire length of the tearstrip remaining unsealed, the end of the package opposite the tearstrip sealed end being the folded end, and the ends of the package transverse to the folded and the tearstrip sealed ends thereof being sealed by the application of energy, whereupon forcibly removing the tearstrip, the entire length of the front surface of the package separates in a line along the unsealed edge of the tearstrip in the direction of the removing force, the tearstrip simultaneously delaminating from the rear surface without substantially tearing said rear surface thus leaving two substantially non-ragged package edges that do not impede the extraction of said photographic film.

42. An enclosed envelope-like package for photographic film according to claim 41 wherein 1 to 3 photographic films are present.

43. An enclosed envelope-like package for photographic film according to claim 42 wherein the photographic films are sandwiched between x-ray intensifying screens.

44. An enclosed envelope-like package for photographic film according to claim 42 wherein the ends of the package transverse to the folded and tearstrip sealed ends thereof are heat sealed.

45. An enclosed envelope-like package for photographic film according to claim 42 wherein the ends of the package transverse to the folded and tearstrip sealed end thereof are ultrasonic welded.

46. An enclosed envelope-like package for photographic film according to claim 42 wherein the air within the package is evacuated thus forming a vacuum package.

* * * * *

UNITED STATES PATENT AND TRADEMARK OFFICE

CERTIFICATE OF CORRECTION

PATENT NO. : 4,720,011

DATED : Jan. 19, 1988

INVENTOR(S) : Canamero

It is certified that error appears in the above-identified patent and that said Letters Patent is hereby corrected as shown below:

Cover page, left column, "[73] Assignee: E. I. du Pont de Nemours Company, Wilmington, Del." should be --[73] Assignee: Rockford Automation, Inc. Rockford, Illinois--.

Signed and Sealed this

Fourth Day of October, 1988

*Attest:*

*Attesting Officer*

DONALD J. QUIGG

*Commissioner of Patents and Trademarks*